US006606771B2

(12) United States Patent
Curtis et al.

(10) Patent No.: US 6,606,771 B2
(45) Date of Patent: Aug. 19, 2003

(54) METHOD OF IMAGING WOVEN TEXTILE FABRIC

(75) Inventors: Charles Keith Curtis, Benson, NC (US); Kenneth Daniels, Benson, NC (US); Kay Goodson, Littleton, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 09/918,205

(22) Filed: Jul. 31, 2001

(65) Prior Publication Data

US 2002/0050037 A1 May 2, 2002

Related U.S. Application Data

(60) Provisional application No. 60/221,757, filed on Jul. 31, 2000.

(51) Int. Cl.[7] ..... D06B 5/08; D06C 23/00

(52) U.S. Cl. ..... 28/167; 28/163

(58) Field of Search ..... 28/167, 104, 105, 28/106, 151, 163; 26/69 R; 8/151; 68/205 R

(56) References Cited

U.S. PATENT DOCUMENTS 3,485,706 A 12/1969 Evans
3,551,265 A * 12/1970 Jackson ..... 28/104
4,083,090 A * 4/1978 Duvekot ..... 28/106
4,868,958 A * 9/1989 Suzuki et al. ..... 28/104
4,959,894 A * 10/1990 Jeffers et al. ..... 28/104
4,967,456 A 11/1990 Sternlieb et al.
4,995,151 A 2/1991 Siegel et al.
5,098,764 A 3/1992 Drelich et al.
5,136,761 A * 8/1992 Sternlieb et al. ..... 28/104
5,142,752 A * 9/1992 Greenway et al. ..... 28/104
5,244,711 A 9/1993 Drelich et al.
5,274,893 A * 1/1994 Kitamura et al. ..... 28/105
5,414,914 A * 5/1995 Suzuki et al. ..... 28/105
5,632,072 A * 5/1997 Simon et al. ..... 26/69 R
5,822,823 A 10/1998 Polzin et al.
5,822,833 A * 10/1998 James et al. ..... 28/105
5,827,597 A 10/1998 James et al.
5,870,807 A * 2/1999 Beaty et al. ..... 28/167
6,024,553 A * 2/2000 Shimalla ..... 264/504

* cited by examiner

*Primary Examiner*—Amy B. Vanatta
(74) *Attorney, Agent, or Firm*—Wood, Philips, Katz, Clark & Mortimer

(57) ABSTRACT

The present invention is directed to a method of imaging a woven textile fabric by positioning the fabric on a three-dimensional image transfer device, and subjecting the fabric to treatment with high pressure liquid streams. A regular pattern defined by the image transfer device is thereby durably imparted to the fabric. The use of a three-dimensional image transfer device facilitates efficient commercially viable use of the method, while avoiding the creation of repeating defects which can occur when imaging fabrics on wire mesh screens.

3 Claims, 9 Drawing Sheets

FIGURE 3A "Left hand twill"
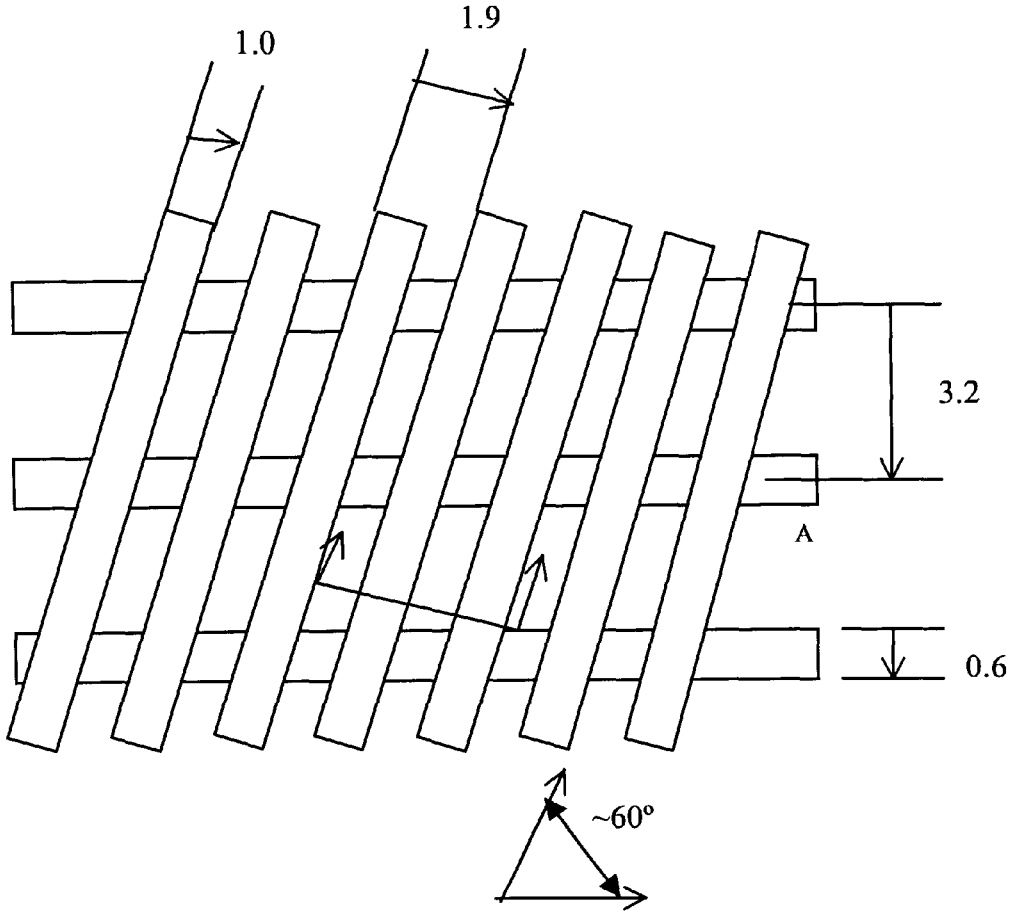
VIEW A - A
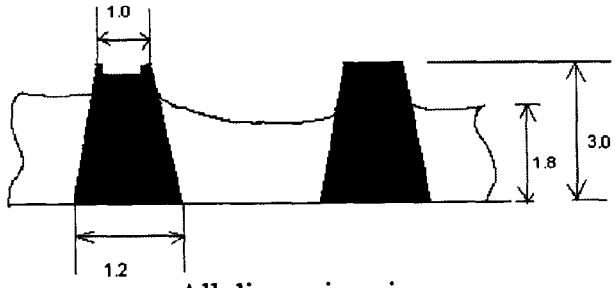
All dimensions in mm
All dimensions are approximate FIGURE 3B "Herringbone"
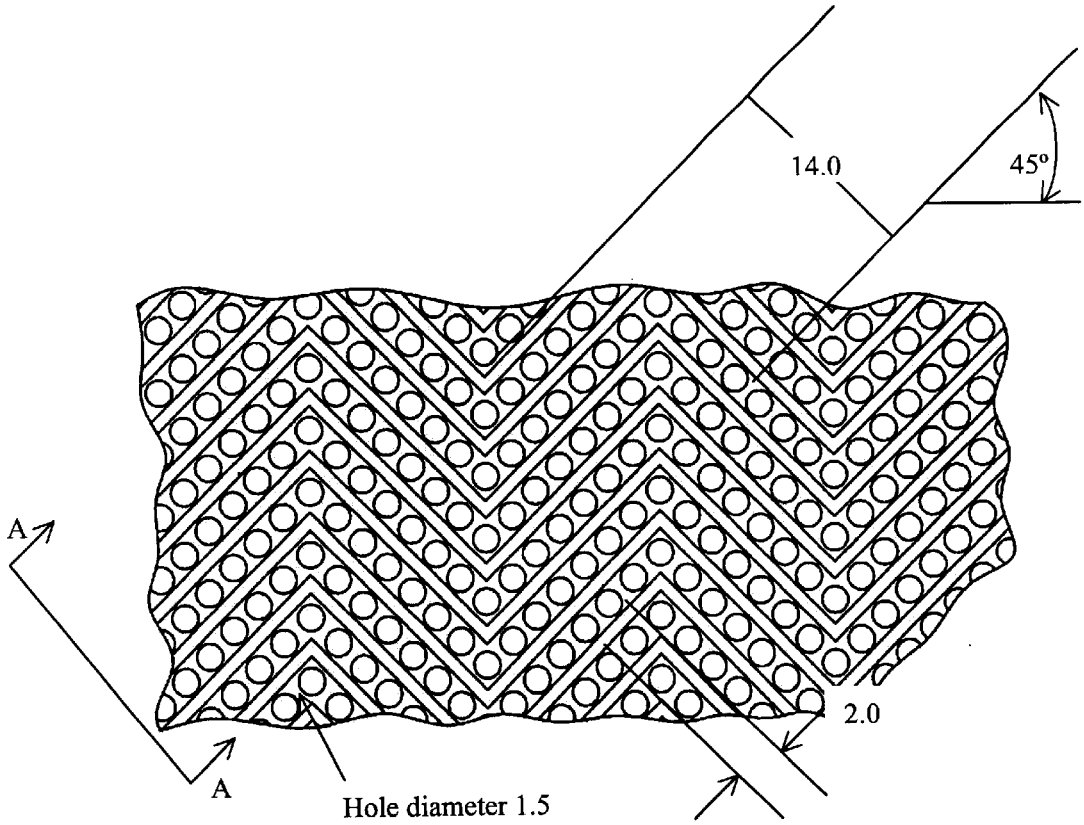
All dimensions in mm
All dimensions are approximate
Section A - A
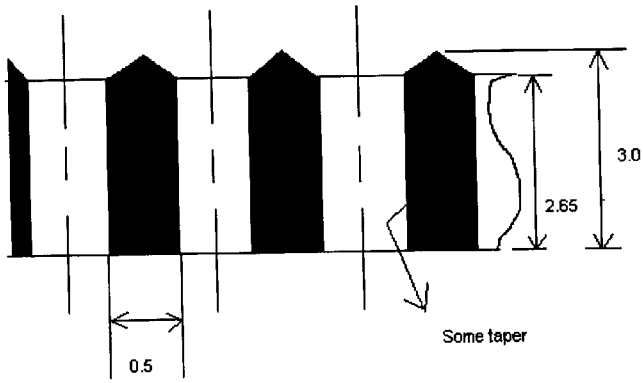

FIGURE 3C "Small Square"
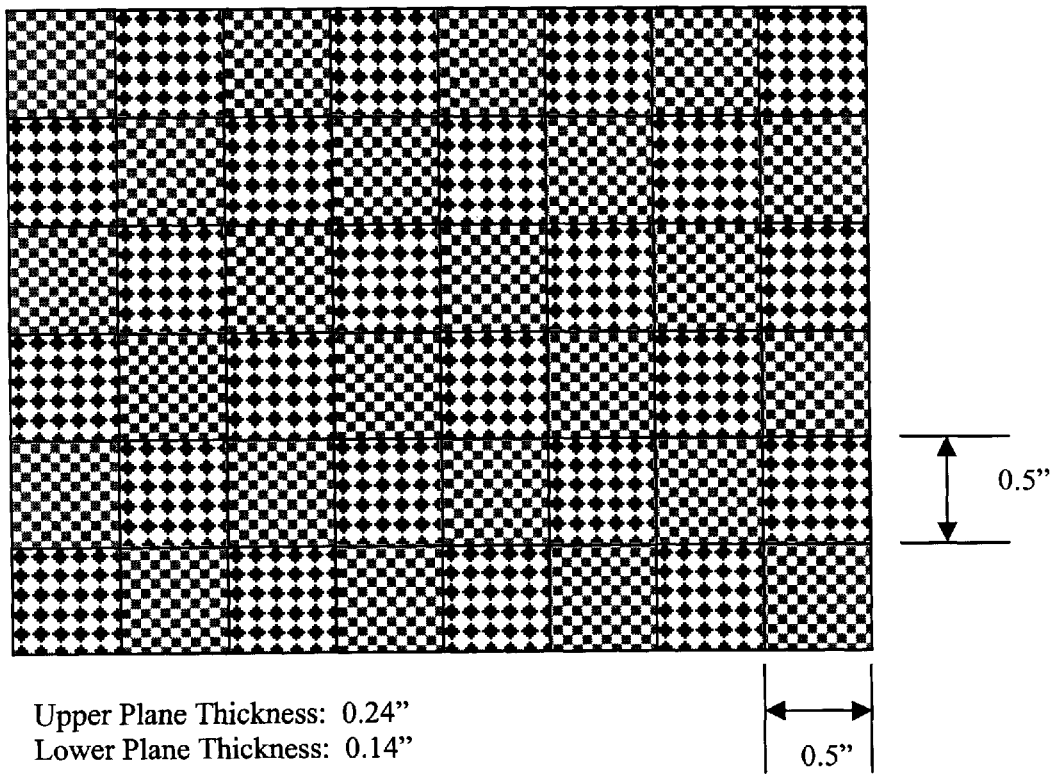

FIGURE 3D "Honeycomb"
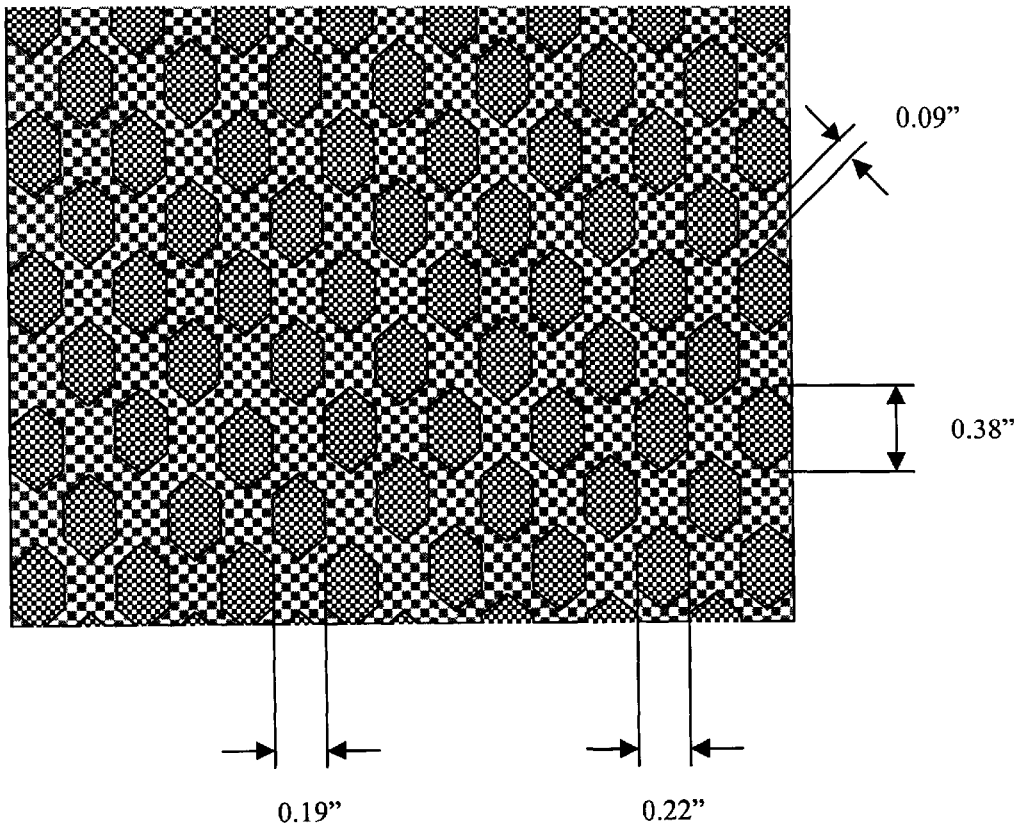
Upper Plane Thickness: 0.24"
Lower Plane Thickness: 0.14"

FIGURE 3E "Zig-zag"
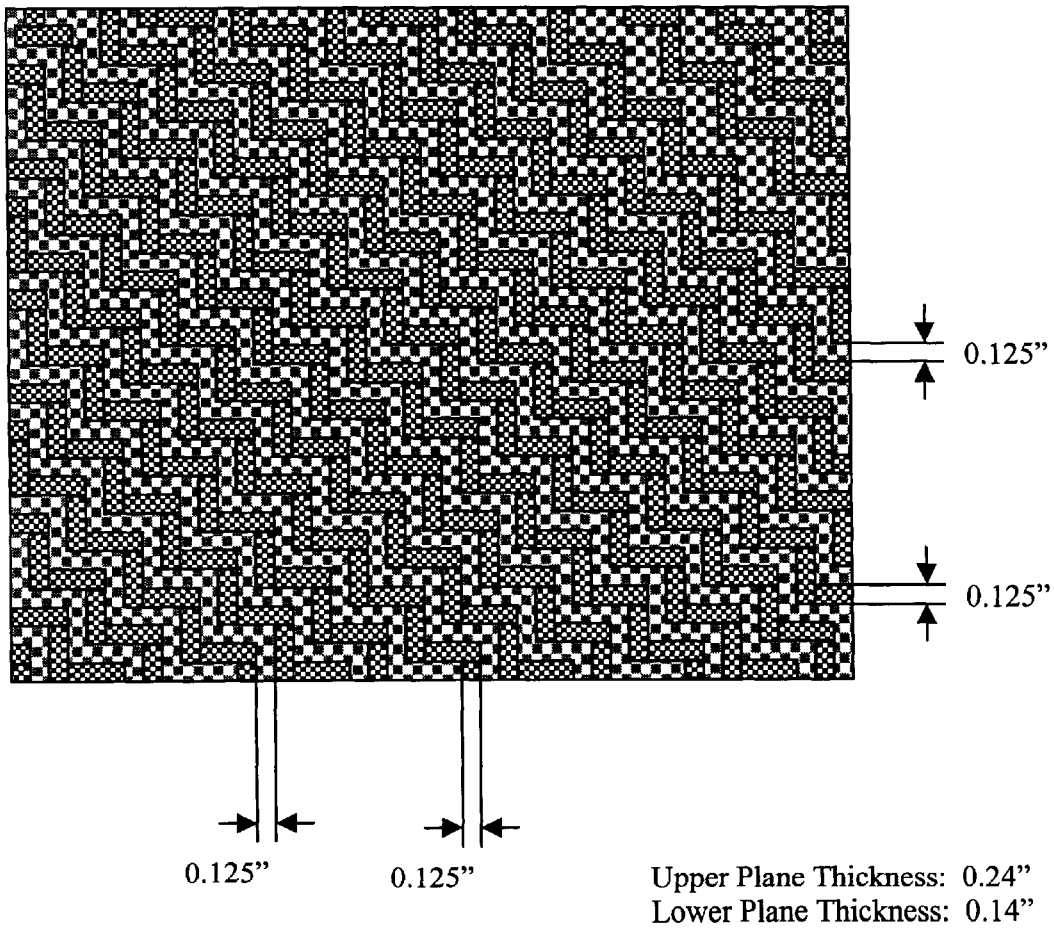

FIGURE 3F "Eight wale"
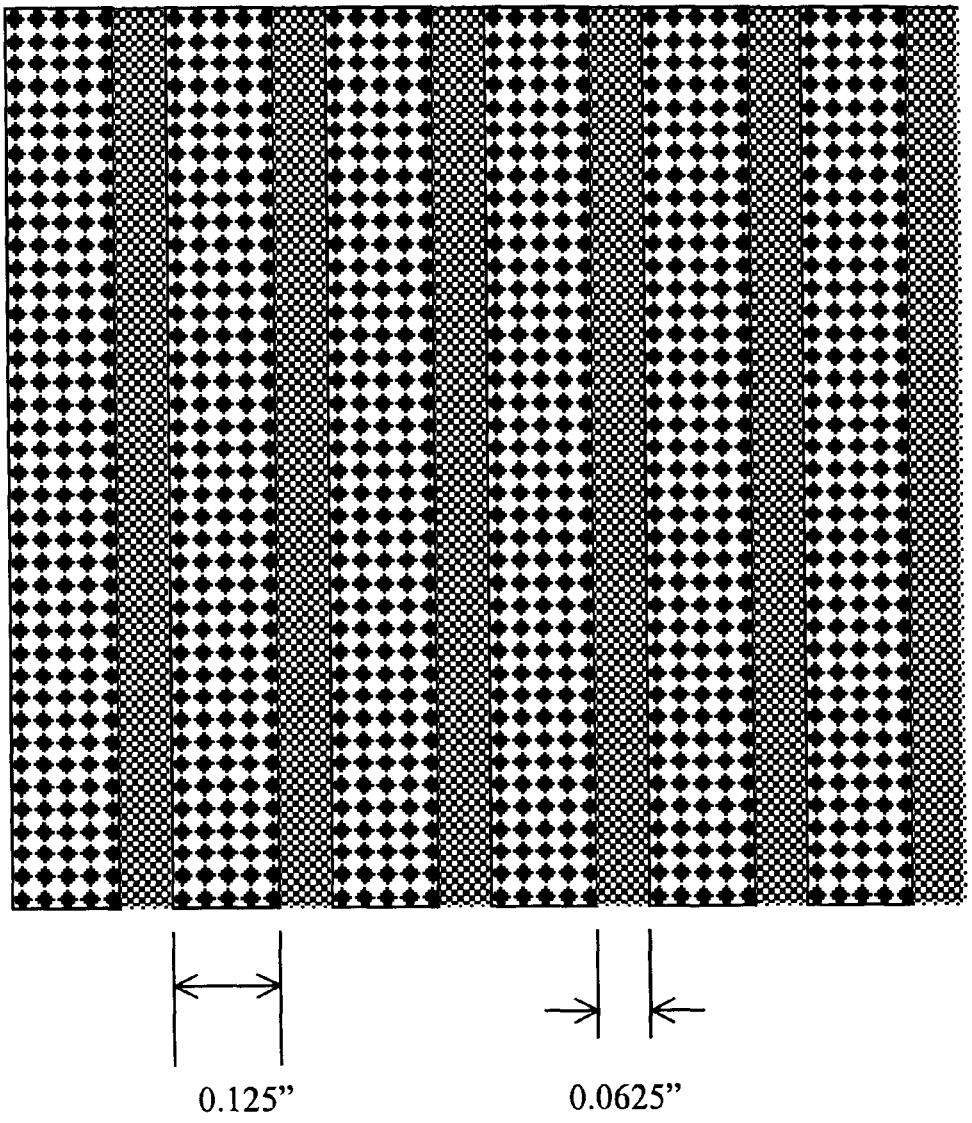

066 – Opt. Image 4

METHOD OF IMAGING WOVEN TEXTILE FABRIC

TECHNICAL FIELD

The present invention relates generally to a method of imaging a woven textile fabric, and more particularly to a method of hydraulically imaging a woven textile fabric on a three-dimensional image transfer device, whereby a regular pattern defined by the image transfer device is imparted to the woven fabric.

BACKGROUND OF THE INVENTION

Woven textile fabrics, of which include a plurality of interwoven warp and weft yams, are used for all manner of applications, including apparel, home furnishings, recreational products, and industrial applications. In regards to these applications, it has become desirable to impart a visual or other patterned effect on some types of fabrics. The application of an image onto a fabric may have aesthetic as well as functional benefits.

U.S. Pat. Nos. 4,967,456 and 4,995,151, hereby incorporated by reference, disclose techniques for hydro-enhancing and hydro-patterning fabric. Practice of hydro-enhancing and hydro-patterning techniques requires the use of a woven screen. The woven screen may be embossed with the desired three-dimensional pattern, which is then used as the foraminous surface against which woven fabrics are treated with hydraulic energy. The use of mesh screens however, has an inherent and deleterious flaw, which precludes the acceptable treatment on continuous yardages of woven material. In order to form a woven screen to be used to treat continuous yardage of material, the screen must be linked at its terminal edges, thus forming a loop or belt. Where the terminal ends of the mesh screen meet to form the loop, there are a plurality of wire ends, which must be adjoined. A seam is formed across the length of the formed loop. FIG. 1 depicts such a seam from a woven, mesh screen. This seam becomes part of the overall three-dimensional pattern and creates a repeating defect in the course of treatment of continuous yardage, such a defect is undesirable in a commercial process.

Typically, manufacture of nonwoven fabrics entails creating a web or batt of fibrous and filamentary material, and treating the web in a manner to provide the resultant fabric with the desired physical properties. One manner of making nonwoven fabrics, which has met with widespread commercial success involves hydraulically treating the fabric with high-pressure liquid (water) streams, which act to entangle and integrate the fibrous material. Such hydroentangling techniques are disclosed in U.S. Pat. No. 3,485,706, to Evans, hereby incorporated by reference. More recently, hydroentangling techniques have been developed for nonwovens fabrics whereby patterning and imaging of the fabric can be effected as the fabric is hydraulically formed on a three-dimensional image transfer device. U.S. Pat. Nos. 5,098,764, 5,244,711, 5,822,823, and 5,827,597, the disclosures of which are hereby expressly incorporated by reference, relate to the use of such three-dimensional image transfer devices.

Applying this image transfer method to wovens would allow for the production of continuous yardage without the shortcoming of the repeating defect left by a seam from the woven screen. The present invention contemplates a method of applying hydraulic energy in conjunction with a three-dimensional transfer device, whereby a specific and desirable pattern defined by the image transfer device is durably imparted to the woven fabric. The use of a three-dimensional image transfer device is necessary to facilitate the efficient and commercially viable use of the method.

SUMMARY OF THE INVENTION

The present method of imaging a woven textile fabric having a plurality of interwoven warp and weft yarns, preferably comprising cellulosic fibers, contemplates that a three-dimensional image transfer device be provided. The image transfer device has a foraminous, image-forming surface comprising a regular or irregular pattern of three-dimensional surface elements. As a result of the way the image transfer device is made, it does not have any seams that can be imparted to the fabric. In addition, the surface topography and the drainage topology can be controlled to a very high degree.

The woven textile fabric is positioned on the image transfer device, and hydraulic imaging of the fabric effected by subjecting the fabric to pressurized liquid streams applied to a surface of the fabric facing away from the image transfer device. By the action of the high-pressure liquid stream, the regular pattern defined by the image-forming surface of the image transfer device is imparted to the woven fabric.

The pattern imparted to the fabric may include an image which results from rearrangement and displacement of the fabric yarns, which can impart a three-dimensionality to the fabric, as well as patterning which results from differential washing of dyes or color from the fabric which corresponds to the pattern of the image transfer device.

The present method has been practiced for imparting an image to denim fabrics comprising cotton cellulosic fibers. As will be appreciated, the technique can be employed for imparting an image to a wide variety of textile fabrics. Standard, low cost textile products can be transformed into high value, three-dimensional fabrics suitable for many apparel, home furnishing, upholstery, and other applications. A fabric which is otherwise substantially uniform in appearance can be provided with an aesthetically pleasing pattern, reflecting the three-dimensionality of the fabric and/or color variations therein.

BRIEF DESCRIPTION OF THE DRAWINGS

FIGS. 3A–3F are diagrammatic views of the image-forming surface of a three-dimensional image transfer device of the apparatus shown in FIG. 1.

DETAILED DESCRIPTION

Figure 1:
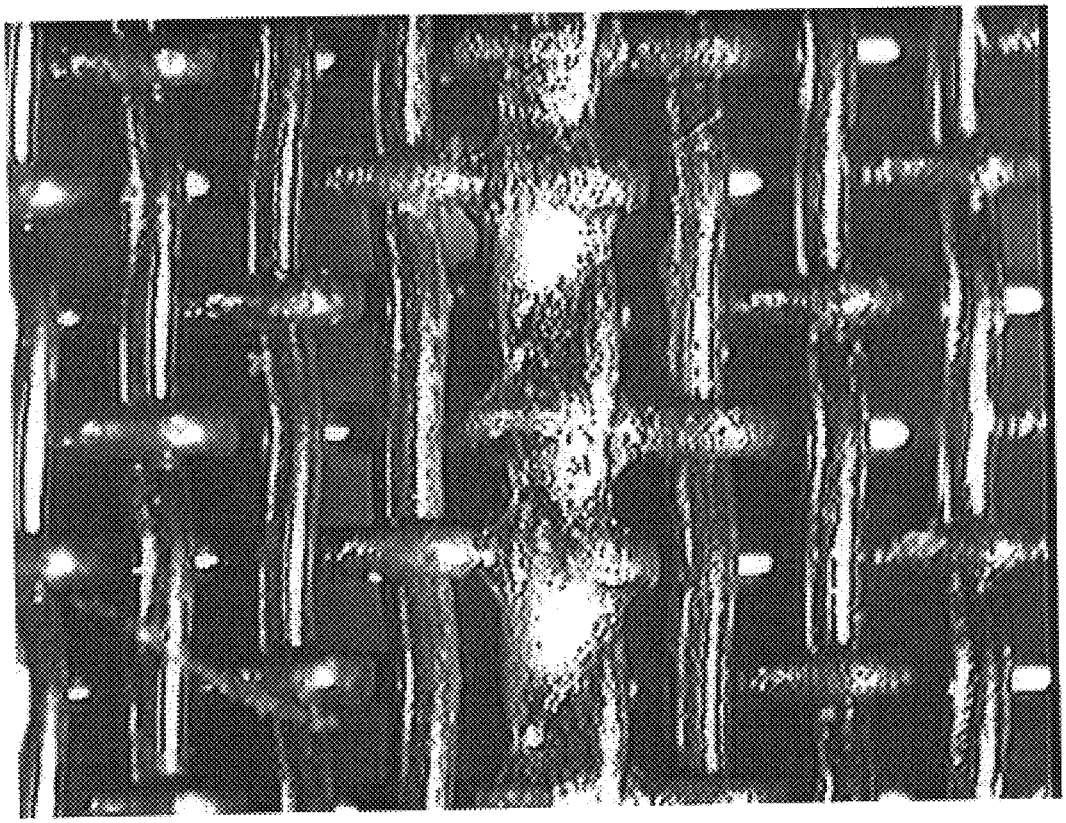
FIG. 1 is a photomicrograph depicting a seam in a woven mesh screen.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

The present invention contemplates continuous and seamless patterning and imaging of woven textile fabrics, such as denim, comprising a plurality of interwoven warp and weft yarns comprising cellulosic fibers, such as cotton. Positioning of such a woven fabric on the image-forming surface of a three-dimensional image transfer device in conjunction with hydraulic treatment of the fabric desirably acts to efficiently impart a pattern defined by the image transfer device to the fabric. Under the influence of high-pressure liquid (water) streams, hydraulic treatment of the woven fabric results in displacement of the interwoven yarns so that the fabric is patterned in a fashion corresponding to the pattern defined by the image transfer device. Additionally, imaging of the fabric can be effected as a result of the washing of dyes from the fabric under the influence of the high-pressure liquid streams, thus enhancing the three-dimensional imaging which can be created, or providing a pattern of color differentiation which can, in itself, be desirable.

Figure 2:
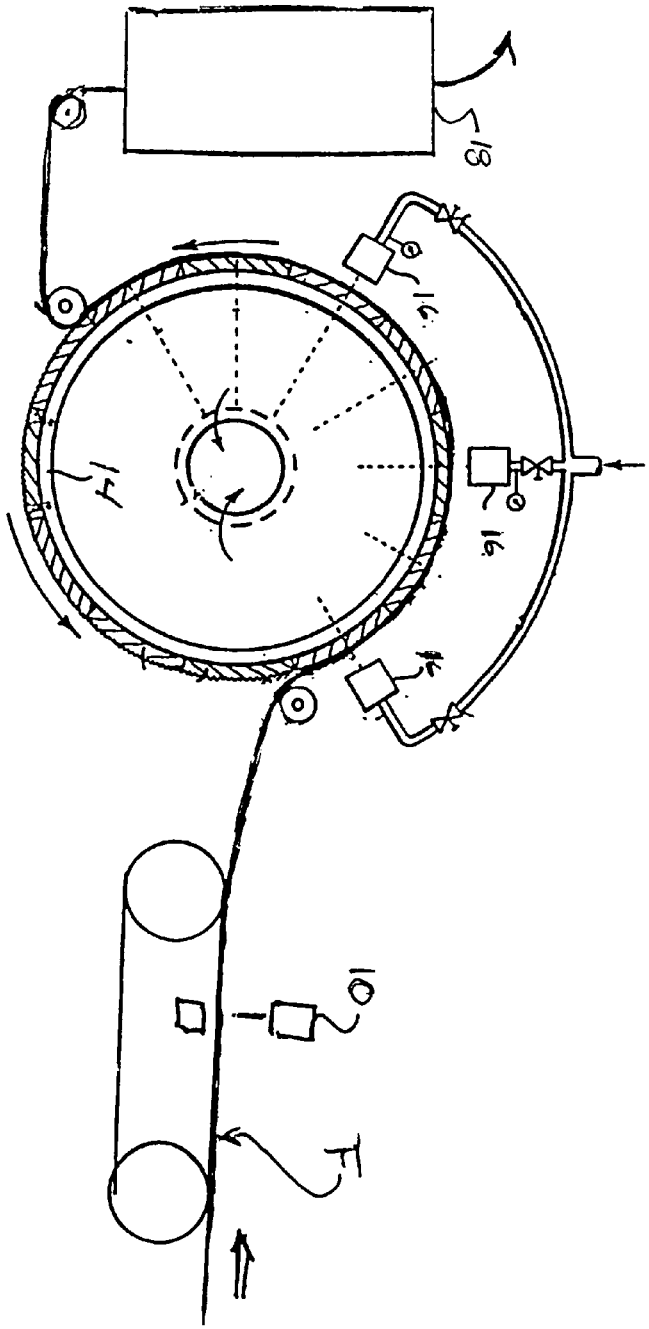
FIG. 2 is a diagrammatic view of an apparatus for imaging a woven textile fabric embodying the principles of the present invention.

FIG. 2 illustrates an apparatus for hydraulically treating woven textile fabrics in accordance with the present invention. The apparatus includes a pre-wetting station 10 at which a precursor woven textile fabric F is positioned for pre-wetting. A pre-wetting manifold may be operated at a pressure on the order of 100 psi to thereby effect pre-wetting of the woven textile fabric F.

The apparatus illustrated in FIG. 2 further includes a patterning drum 14 comprising a three-dimensional image transfer device for effecting imaging and patterning of the woven textile fabric. The image transfer device includes a movable imaging surface defining a regular or irregular pattern which moves relative to a plurality of entangling manifolds 16 which act in cooperation with three-dimensional elements defined by the imaging surface of the image transfer device to effect imaging and patterning of the woven textile fabric.

The woven textile fabric is advanced onto the image transfer device so that the fabric is positioned on the image-forming surface of the device. The fabric is moved together with the imaging surface relative to the manifolds 16 so that high-pressure liquid streams are directed against the surface of the fabric, which faces away from the image-forming surface of the image transfer device.

In current practice of the present invention, three manifolds 16 have been employed, each comprising a single row of orifices each having a diameter of 0.0047 inches, with orifices spaced at 43 per inch. Line speeds on the order of 45 feet per minute have been employed, with one stack of drying cans 18 provided operating at approximately 3500 F. The manifolds can be operated at pressures ranging from 2800 to 4700 psi, with current examples of woven textile fabrics hydraulically treated at pressures on the order of 4200 psi.

FIG. 3A illustrates the image-forming surface of an image transfer device having a "left-hand twill image pattern. FIG. 3B illustrates a so-called "herringbone" pattern of the forming surface of the image transfer device. FIG. 3C illustrates a so-called "small square" forming pattern of the image transfer device. FIG. 3D illustrates a so-called "honeycomb" forming pattern of the image transfer device. FIG. 3E illustrates a so-called "zig-zag" forming pattern of the image transfer device. FIG. 3F illustrates a so-called "eight wale" forming pattern of the image transfer device.

Figure 4:
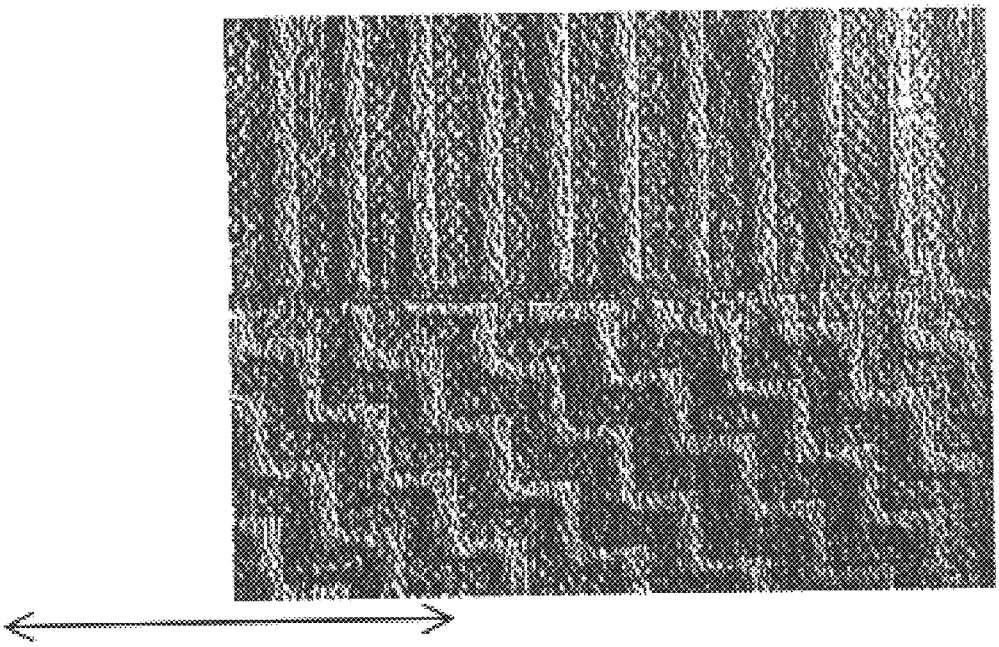
FIG. 4 is a photomicrograph of a piece of denim fabric imaged according to the invention described herein with an image transfer device with two distinct patterns, "zig-zag" and "eight wale".

The image transfer devices have several advantages over woven mesh screens. The three-dimensional image transfer devices (ITDs) do not have seams that may be transferred into the image of the fabric, allowing for the production of continuous yardage of imaged fabric. The surface topography of the ITD can be controlled to a high degree, allowing for the control of fiber movement around the surface features. Complicated patterns may be formed in the fabric as shown in FIG. 4, which is a photomicrograph of a piece of imaged denim fabric, imaged with two different patterns "eight wale" and "zig-zag" In addition, the percent open area of the ITD and the shape of the drainage apertures can also be varied within constraints dictated by a particular pattern. The ability to control and vary the drainage characteristic of the imaging device can affect the aesthetic and physical properties of the imaged fabric, such control is not possible with woven screens.

From the foregoing, numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A method of imaging a woven textile fabric, comprising the steps of:

providing a woven textile fabric having a plurality of interwoven warp and weft yarns comprising fibers;

providing a three-dimensional image transfer device having a foraminous image-forming surface comprising a pattern of three-dimensional surface elements, said image-forming surface of said image transfer device being seamless;

positioning said woven textile fabric on said image transfer device, and hydraulically imaging said textile fabric by subjecting said fabric to pressurized liquid streams applied to a surface of said fabric facing away from said image transfer device to thereby impart said regular pattern of said image-forming surface to said fabric without any repeating defect left by said seamless image-forming surface.

2. A method of imaging a woven textile fabric in accordance with claim 1, wherein:

said fiber comprises cellulosic fibers.

3. A method of imaging a woven textile fabric, comprising the steps of:

providing a woven textile fabric having a plurality of interwoven warp and weft yarns comprising cellulosic fibers;

providing substantially continuous yardage of a three-dimensional image transfer device having a foraminous image-forming surface comprising a pattern of three-dimensional surface elements, said image-forming surface of said image transfer device being seamless;

positioning said woven textile fabric on said image transfer device, and hydraulically imaging said textile fabric by subjecting said fabric to pressurized liquid streams applied to a surface of said fabric facing away from said image transfer device to thereby impart said regular pattern of said image-forming surface to said fabric, wherein said regular pattern is substantially free of any repeating defects left by said seamless image-forming surface of said image-transfer device.

* * * * *